US012169105B1

(12) United States Patent
Barry

(10) Patent No.: US 12,169,105 B1
(45) Date of Patent: Dec. 17, 2024

(54) FIREARM SEMIAUTOMATIC TRIGGER MECHANISM

(71) Applicant: ABC IP, LLC, Dover, DE (US)

(72) Inventor: Nicholas George Barry, Albuquerque, NM (US)

(73) Assignee: ABC IP, LLC, Dover, DE (US)

( * ) Notice: Subject to any disclaimer, the term of this patent is extended or adjusted under 35 U.S.C. 154(b) by 0 days.

(21) Appl. No.: 18/760,089

(22) Filed: Jul. 1, 2024

Related U.S. Application Data

(60) Provisional application No. 63/523,934, filed on Jun. 29, 2023.

(51) Int. Cl.
*F41A 19/10* (2006.01)
*F41A 19/14* (2006.01)

(52) U.S. Cl.
CPC ..... *F41A 19/10* (2013.01); *F41A 19/14* (2013.01)

(58) Field of Classification Search
CPC ..... F41A 19/10; F41A 19/19; F41A 19/14; F41A 19/00; F41A 19/37; F41A 19/12; F41A 17/00; F41A 17/42; F41A 17/56; F41A 17/62
See application file for complete search history.

(56) References Cited

U.S. PATENT DOCUMENTS

| | | | |
|---|---|---|---|
| 2,765,562 | A | 10/1956 | Roper et al. |
| 3,045,555 | A | 7/1962 | Stoner |
| 3,292,492 | A | 12/1966 | Sturtevant |
| 3,301,133 | A | 1/1967 | Sturtevant |
| 3,670,442 | A | 6/1972 | Kennedy et al. |
| 4,023,465 | A | 5/1977 | Inskip |
| 4,057,003 | A | 11/1977 | Atchisson |
| 4,151,670 | A | 5/1979 | Rath |

(Continued)

FOREIGN PATENT DOCUMENTS

| | | | |
|---|---|---|---|
| DE | 582963 | C | 8/1933 |
| DE | 4008351 | A1 | 9/1991 |

(Continued)

OTHER PUBLICATIONS

Statutory Invention Registration No. H107, Inventor: Bauer, Published Aug. 5, 1986 (8 pages).

*Primary Examiner* — J. Woodrow Eldred
(74) *Attorney, Agent, or Firm* — Wood Herron & Evans LLP

(57) ABSTRACT

A trigger mechanism having a hammer, a trigger member, disconnector, movable ejector lever, locking member, and safety the trigger member. The trigger member being forced to the set position by the hammer during rearward pivoting. A locking member is adapted to move between a first position at which the locking member mechanically blocks the trigger member from moving to the released position and a second position at which the locking member does not mechanically block the trigger member allowing the trigger member to be moved to the released position. The locking member is spring biased toward the first position and moved against the spring bias to the second position by contact from the movable ejector lever during forward movement of the bolt carrier as the bolt carrier reaches a substantially in-battery position. The safety selector is adapted to pivot between safe, standard semi-automatic, and forced reset semi-automatic positions.

5 Claims, 8 Drawing Sheets

(56) References Cited

U.S. PATENT DOCUMENTS

| | | | |
|---|---|---|---|
| 4,276,808 | A | 7/1981 | York |
| 4,433,610 | A | 2/1984 | Tatro |
| 4,463,654 | A | 8/1984 | Barnes et al. |
| 4,516,466 | A | 5/1985 | Jennie |
| 4,580,484 | A | 4/1986 | Moore |
| 4,656,993 | A | 4/1987 | Yuzawa et al. |
| 4,658,702 | A | 4/1987 | Tatro |
| 4,693,170 | A | 9/1987 | Atchisson |
| 4,697,495 | A | 10/1987 | Beretta |
| 4,787,288 | A | 11/1988 | Miller |
| 4,937,964 | A | 7/1990 | Crandall |
| 5,149,898 | A | 9/1992 | Chesnut et al. |
| 5,183,959 | A | 2/1993 | McCoan et al. |
| 5,223,649 | A | 6/1993 | Claridge |
| 5,339,721 | A | 8/1994 | Beretta |
| 5,517,897 | A | 5/1996 | Perrine |
| 5,614,691 | A | 3/1997 | Taylor |
| 5,623,114 | A | 4/1997 | Soper |
| 5,682,699 | A | 11/1997 | Gentry |
| 5,701,698 | A | 12/1997 | Wesp et al. |
| 5,704,153 | A | 1/1998 | Kaminski et al. |
| 5,760,328 | A | 6/1998 | Robbins |
| 5,770,814 | A | 6/1998 | Ealovega |
| 6,101,918 | A | 8/2000 | Akins |
| 6,360,467 | B1 | 3/2002 | Knight |
| 6,601,331 | B2 | 8/2003 | Salvitti |
| 6,718,680 | B2 | 4/2004 | Roca et al. |
| 6,722,072 | B1 | 4/2004 | McCormick |
| 6,851,346 | B1 | 2/2005 | Herring |
| 6,889,459 | B1 | 5/2005 | Salvitti |
| 6,976,416 | B2 | 12/2005 | Ealovega |
| 7,051,638 | B2 | 5/2006 | Thomele |
| 7,162,824 | B1 | 1/2007 | McCormick |
| 7,213,359 | B2 | 5/2007 | Beretta |
| 7,293,385 | B2 | 11/2007 | McCormick |
| 7,337,574 | B2 | 3/2008 | Crandall et al. |
| 7,347,021 | B1 | 3/2008 | Jones |
| 7,398,723 | B1 | 7/2008 | Blakley |
| 7,421,937 | B1 | 9/2008 | Gangl |
| 7,634,959 | B2 | 12/2009 | Frickey |
| 7,661,220 | B2 | 2/2010 | Crandall et al. |
| 7,806,039 | B1 | 10/2010 | Gomez |
| 8,037,805 | B1 | 10/2011 | Neroni |
| 8,112,928 | B2 | 2/2012 | Keough |
| 8,127,658 | B1 | 3/2012 | Cottle |
| 8,156,854 | B2 | 4/2012 | Brown |
| 8,443,537 | B2 | 5/2013 | Curry |
| 8,464,454 | B2 | 6/2013 | Martin et al. |
| 8,490,309 | B2 | 7/2013 | Zukowski |
| 8,667,881 | B1 | 3/2014 | Hawbaker |
| 8,695,477 | B2 | 4/2014 | Esch |
| 8,720,096 | B2 | 5/2014 | Siddle |
| 8,820,211 | B1 | 9/2014 | Hawbaker |
| 8,893,607 | B2 | 11/2014 | Audibert et al. |
| 8,925,234 | B1 | 1/2015 | Barrett |
| 8,985,006 | B1 | 3/2015 | Christensen et al. |
| 9,016,187 | B2 | 4/2015 | Findlay |
| 9,021,732 | B2 | 5/2015 | Johnson |
| 9,021,733 | B1 | 5/2015 | DiChario |
| 9,052,150 | B2 | 6/2015 | Talasco |
| 9,121,661 | B2 | 9/2015 | Calvete |
| 9,146,066 | B1 | 9/2015 | Cason |
| 9,146,067 | B2 | 9/2015 | Stakes |
| 9,182,189 | B2 | 11/2015 | Seigler |
| 9,228,786 | B2 | 1/2016 | Sullivan et al. |
| 9,310,150 | B1 | 4/2016 | Geissele |
| 9,347,726 | B1 | 5/2016 | Thomas |
| 9,448,023 | B2 | 9/2016 | Sheets, Jr. et al. |
| 9,476,660 | B2 | 10/2016 | Potter et al. |
| 9,513,076 | B2 | 12/2016 | Kolev et al. |
| 9,568,264 | B2 | 2/2017 | Graves |
| 9,618,288 | B2 | 4/2017 | Wilson |
| 9,618,289 | B1 | 4/2017 | Geissele |
| 9,625,231 | B1 | 4/2017 | Hass |
| 9,631,886 | B2 | 4/2017 | Findlay |
| 9,651,329 | B2 | 5/2017 | Hittmann |
| 9,658,007 | B2 | 5/2017 | Withey |
| 9,683,800 | B2 | 6/2017 | Sewell, Jr. et al. |
| 9,733,031 | B1 | 8/2017 | Sylvester et al. |
| 9,759,504 | B2 | 9/2017 | Geissele |
| 9,777,980 | B2 | 10/2017 | Heizer |
| 9,810,493 | B2 | 11/2017 | Fluhr et al. |
| 9,810,496 | B2 | 11/2017 | Kolev et al. |
| 9,816,772 | B2 | 11/2017 | Graves |
| 9,829,263 | B2 | 11/2017 | Bonner |
| 9,835,398 | B2 | 12/2017 | Biegel |
| 9,863,730 | B2 | 1/2018 | Elftmann |
| 9,869,522 | B2 | 1/2018 | Larson, Jr. et al. |
| 9,874,417 | B2 | 1/2018 | Zajk et al. |
| 9,927,197 | B1 | 3/2018 | Geissele |
| 9,939,221 | B2 | 4/2018 | Graves |
| 10,002,500 | B2 | 6/2018 | Hall et al. |
| 10,006,734 | B1 | 6/2018 | Findlay |
| 10,030,924 | B1 | 7/2018 | Smith |
| 10,077,960 | B2 | 9/2018 | Geissele |
| 10,107,580 | B2 | 10/2018 | Fellows et al. |
| 10,254,067 | B2 | 4/2019 | Foster |
| 10,267,584 | B2 | 4/2019 | Kasanjian-King |
| 10,330,413 | B2 | 6/2019 | Williams et al. |
| 10,488,136 | B2 | 11/2019 | Sullivan et al. |
| 10,502,511 | B2 | 12/2019 | Graves |
| 10,514,223 | B1 | 12/2019 | Rounds |
| 10,584,932 | B2 | 3/2020 | Foster |
| 10,816,297 | B1 | 10/2020 | Williams et al. |
| 11,287,205 | B2 | 3/2022 | Biegel |
| 11,293,715 | B1 | 4/2022 | Newsome et al. |
| 11,346,627 | B1 | 5/2022 | DeMonico |
| 11,724,003 | B2 | 8/2023 | Strbac |
| 12,031,784 | B1 | 7/2024 | DeMonico |
| 12,036,336 | B2 | 7/2024 | Strbac |
| 12,038,247 | B2 | 7/2024 | Blakley |
| 2006/0048426 | A1 | 3/2006 | Crandall |
| 2006/0101695 | A1 | 5/2006 | Longueira |
| 2007/0051236 | A1 | 3/2007 | Groves et al. |
| 2007/0199435 | A1 | 8/2007 | Hochstrate et al. |
| 2009/0151213 | A1 | 6/2009 | Bell |
| 2009/0188145 | A1 | 7/2009 | Fluhr et al. |
| 2011/0209607 | A1 | 9/2011 | St. George |
| 2013/0118343 | A1 | 5/2013 | Hirt |
| 2014/0311004 | A1 | 10/2014 | Barrett |
| 2016/0010933 | A1 | 1/2016 | Bonner |
| 2016/0102933 | A1 | 4/2016 | Graves |
| 2016/0161202 | A1 | 6/2016 | Larue |
| 2017/0176124 | A1 | 6/2017 | Wilson |
| 2017/0198999 | A1* | 7/2017 | Goddard ..... F41A 15/16 |
| 2017/0219307 | A1 | 8/2017 | Foster |
| 2017/0276447 | A1 | 9/2017 | Foster |
| 2017/0284761 | A1 | 10/2017 | Lewis et al. |
| 2017/0299309 | A1 | 10/2017 | Fellows et al. |
| 2017/0328663 | A1 | 11/2017 | Fellows et al. |
| 2018/0066911 | A1 | 3/2018 | Graves |
| 2018/0087860 | A1 | 3/2018 | Sullivan et al. |
| 2018/0112944 | A1 | 4/2018 | Underwood et al. |
| 2018/0195823 | A1 | 7/2018 | Schafer et al. |
| 2018/0202740 | A1 | 7/2018 | Elftmann, Jr. |
| 2018/0231342 | A1 | 8/2018 | Martinez |
| 2020/0191513 | A1 | 6/2020 | Foster |
| 2021/0222974 | A1 | 7/2021 | Graves |
| 2022/0364812 | A1 | 11/2022 | Fellows |
| 2023/0097725 | A1 | 3/2023 | Davis et al. |
| 2024/0085136 | A1* | 3/2024 | Blakley ..... F41A 19/45 |

FOREIGN PATENT DOCUMENTS

| | | | |
|---|---|---|---|
| EP | 1678458 | B1 | 2/2012 |
| EP | 2950033 | B1 | 11/2016 |
| TW | 409847 | U | 10/2000 |
| WO | 2016/028337 | A1 | 2/2016 |
| WO | 2018/058174 | A1 | 4/2018 |

* cited by examiner

FIREARM SEMIAUTOMATIC TRIGGER MECHANISM

RELATED APPLICATIONS

This application is a Nonprovisional Patent Application which claims the benefit of priority to U.S. Provisional Patent Application No. 63/523,934, filed on Jun. 29, 2024, the disclosure of which is incorporated by reference herein.

TECHNICAL FIELD

The present invention relates generally to a firearm trigger mechanism, and more particularly to a semiautomatic trigger that can be selectively mechanically reset by the cycling of the action.

BACKGROUND

In a semiautomatic firearm, functioning of the trigger releases a sear, allowing a hammer or striker to fire a chambered ammunition cartridge. Part of the ammunition's propellant force is used to cycle the action, extracting and ejecting a spent cartridge, and replacing it with a loaded cartridge. The cycle typically includes longitudinal reciprocation of a bolt and/or carrier, which also resets the hammer or striker.

A common semiautomatic trigger mechanism includes a disconnector, which holds the hammer or striker in a cocked position until the trigger member is reset to engage the sear. This is one way to allow the firearm to be fired only a single time when the trigger is pulled and held, because the user is not typically able to release the trigger rapidly enough so that the sear engages before the bolt or bolt carrier returns to its in-battery position. The disconnector prevents the firearm from either firing multiple rounds on a single pull of the trigger, or from allowing the hammer or striker to simply "follow" the bolt as it returns to battery without firing a second round, but leaving the hammer or striker uncocked.

For various reasons, shooters desire to increase the rate of semiautomatic fire. Sometimes this is simply for entertainment and the feeling of shooting as rapidly as a machine gun. In the past, users have been known to employ "bump firing" to achieve rapid semiautomatic fire. Bump firing uses the recoil of the semiautomatic firearm to fire shots in rapid succession. The process involves bracing the rifle with the non-trigger hand, loosening the grip of the trigger hand (but leaving the trigger finger in its normal position in front of the trigger), and pushing the rifle forward in order to apply pressure from the finger to function the trigger while keeping the trigger finger stationary. When fired with the trigger finger held stationary, the firearm will recoil to the rear and allow the trigger to reset as it normally does. When the non-trigger hand pulls the firearm away from the body and back forward toward the original position, it causes the trigger to be pressed against the stationary finger to function again, firing another round as the trigger is pushed back. Devices known as "bump stocks" make bump-firing easier.

Another device for increasing the rate of fire in a different way is shown in U.S. Pat. No. 7,398,723, issued to Brian A. Blakley, and is hereby incorporated by reference herein as if fully set forth in its entirety. This device provides a replacement trigger mechanism in which a rotating cam, contacted by the cycling bolt carrier, forces the trigger member to reset between shots. Other forced reset firearms are shown in U.S. Pat. Nos. 9,568,264; 9,816,772; and U.S. Pat. No. 9,939,221, issued to Thomas Allen Graves. The devices shown in these latter patents forcefully reset the trigger with rigid mechanical contact between the bolt and the trigger member as the action cycles. To adapt this invention to other firearm patterns would require not only a modified fire control mechanism, but also a modified bolt carrier.

Other devices for increasing the rate of semiautomatic fire are shown in U.S. Pat. Nos. 10,514,223, 11,346,627, and 11,724,003, which are hereby incorporated by reference herein as if fully set forth in their entirety. In these devices the hammer forces the trigger to the set position, and a locking member, operated by a spring and contact with the bolt or bolt carrier, prevents early hammer release.

Another device for increasing the rate of semiautomatic fire employing a pivoting cam arrangement is shown in U.S. Provisional Patent Application No. 63/374,941 filed Sep. 8, 2022, now U.S. Pat. No. 12,038,247, issued Jul. 16, 2024 also invented by Brian A. Blakley, and which is hereby incorporated by reference herein as if fully set forth in its entirety. This pivoting cam arrangement incorporates a three-position safety selector and associated structure to provide safe, standard disconnector semi-automatic, and forced reset semi-automatic modes.

There are many popular firearm platforms other than the AR-pattern to which the previously known configurations of forced reset triggers may not be readily adaptable. For example, semi-automatic versions the Heckler & Koch MP5 platform and many variations thereof provide a popular pistol caliber firearm, usually with a roller delayed bolt assembly. While the trigger can be adapted to be forced by the hammer to a reset position, it is difficult to adapt a locking member to be actuated (to unlock the trigger member) by the bolt assembly upon returning to a substantially in-battery position.

Further improvement in forced reset triggers, especially for adaptation to other firearm platforms, is desired.

SUMMARY OF INVENTION

The present invention provides a semiautomatic trigger mechanism for increasing rate of fire that can be retrofitted into other popular existing firearm platforms. In particular, this invention provides a trigger mechanism that can be used in MP5-pattern firearms with an otherwise standard bolt carrier assembly. The present invention is particularly adaptable for construction as a "drop-in" replacement trigger module and safety selector. Advantageously, the present invention provides a "three position" trigger mechanism having safe, standard (disconnector) semi-automatic, and forced reset semi-automatic positions. Actuation of the locking member, rather than by contact with the bolt carrier, is by operation of the pivoting ejector.

In one aspect, a firearm trigger mechanism comprises a hammer having a sear catch and a hook for engaging a disconnector and adapted to be mounted in a trigger housing or frame and then fire control mechanism pocket of a trigger grip housing. A hammer pivots on a transverse hammer pivot axis between set and released positions, the hammer adapted to be pivoted rearward by rearward movement of a bolt carrier, a trigger member having a sear and adapted to be mounted in the fire control mechanism pocket to pivot on a transverse trigger member pivot axis between set and released positions, the trigger member having a surface positioned to be contacted by the hammer during rearward pivoting of the hammer to cause the trigger member to be forced to the set position. The sear and sear catch are in engagement in the set positions of the hammer and trigger member and are out of engagement in the released positions of the hammer and trigger member. A disconnector has a hook for engaging the hammer and is adapted to be movably mounted on the trigger member. A locking member is adapted to be mounted in the fire control mechanism housing to move (for example, pivot on a transverse locking member pivot axis or slide) between a first position at which the locking member mechanically blocks the trigger member from moving to the released position and a second position at which the locking member does not mechanically block the trigger member allowing the trigger member to be moved to the released position, the locking member is spring biased toward the first position and adapted to be moved against the spring bias to the second position by contact from a movable ejector lever during forward movement of the bolt carrier as the bolt carrier reaches a substantially in-battery position. A safety selector is adapted to pivot between safe, standard semi-automatic, and forced reset semi-automatic modes (positions).

In the standard semi-automatic mode, rearward movement of the bolt carrier causes rearward pivoting of the hammer such that the disconnector hook catches the hammer hook, at which time a user must manually reduce pressure on the trigger member so that the trigger spring moves the trigger member to free the hammer from the disconnector, permitting the trigger member to pivot to the set position so that the sear engages the hammer sear notch. Thereafter, the user can pull the trigger member functioning it to fire the firearm again.

In the forced reset semi-automatic mode, rearward movement of the bolt carrier causes rearward pivoting of the hammer causing the trigger member to be forced to the set position. The safety selector prevents the disconnector hook from catching the hammer hook. Instead, the trigger is forced to the reset position where its sear catches the sear notch of the hammer. Original to the MP5-pattern trigger mechanism is an ejector that has the form of a crank arm with a central pivot. Rearward movement of the bolt carrier contacts a rearward arm of the ejector, causing a forward arm to be lifted into the path of the cartridge casing (not shown) being extracted from the chamber. The locking member is spring biased toward a first position in which it locks and prevents movement of the trigger member away from its set position. As the bolt carrier reciprocates to the rear and the forward arm of the ejector is lifted, the locking member is spring biased toward this first position. As the bolt carrier returns forward, the forward arm of the ejector is depressed, which in turn moves the locking member to a second position in which it does not block the trigger member from being functioned by an external force (user's trigger finger) away from the set position. When the bolt carrier reaches the substantially in-battery position, the user can pull the trigger member again to fire a subsequent round.

The safety selector can have a protuberance thereon which, when the safety selector is in the forced reset semi-automatic position, displaces the disconnector preventing the disconnector hook from catching the hammer hook. The trigger mechanism can further include a spring which biases the trigger member toward the set position.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
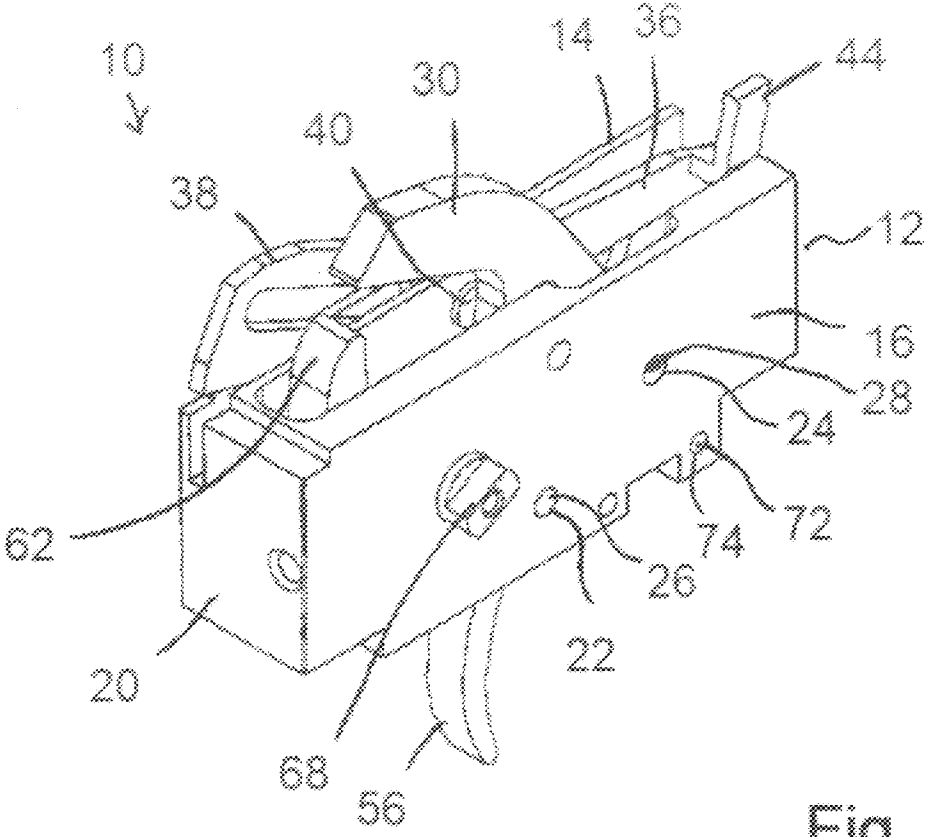
FIG. 1 is a top rear right isometric view of a drop-in trigger module for a MP5-pattern firearm according to one embodiment of the invention.
Figure 2:
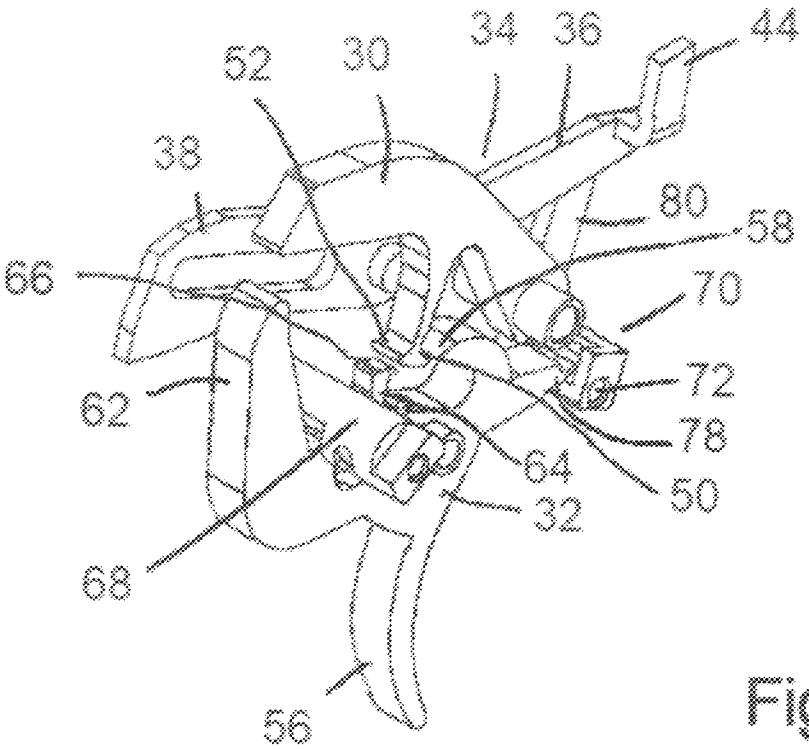
FIG. 2 is a similar view with the trigger housing removed for clarity.
Figure 3:
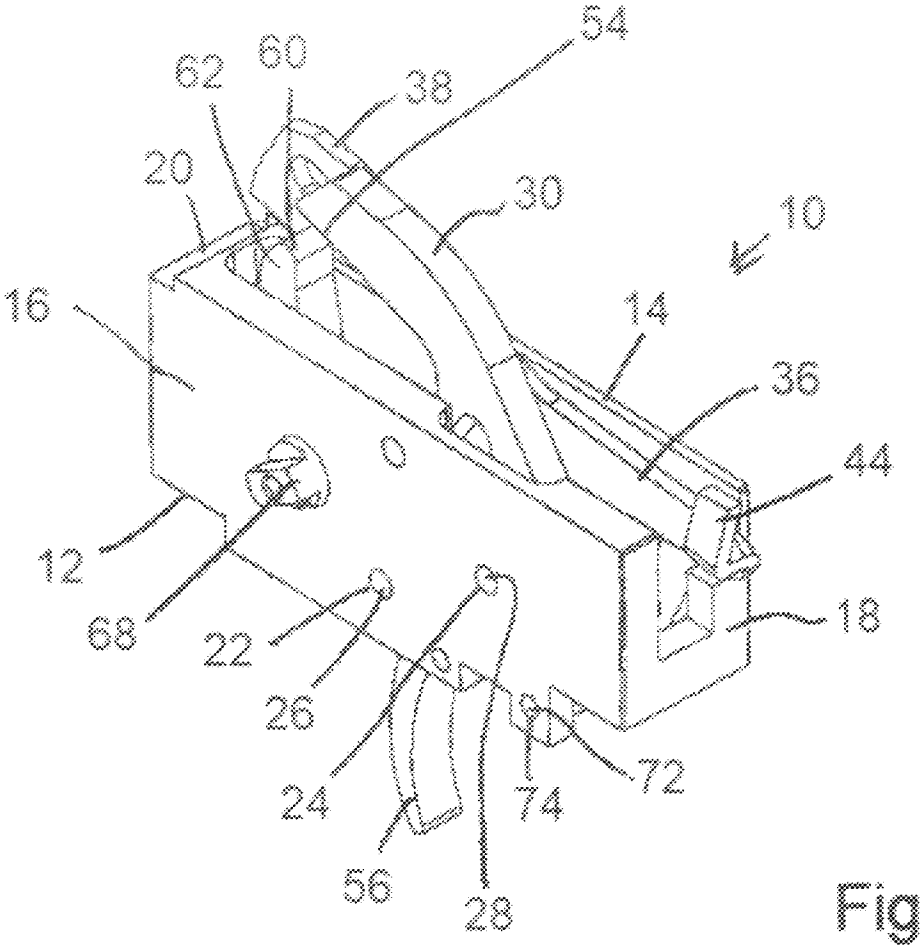
FIG. 3 is a top right front isometric view thereof.
Figure 4:
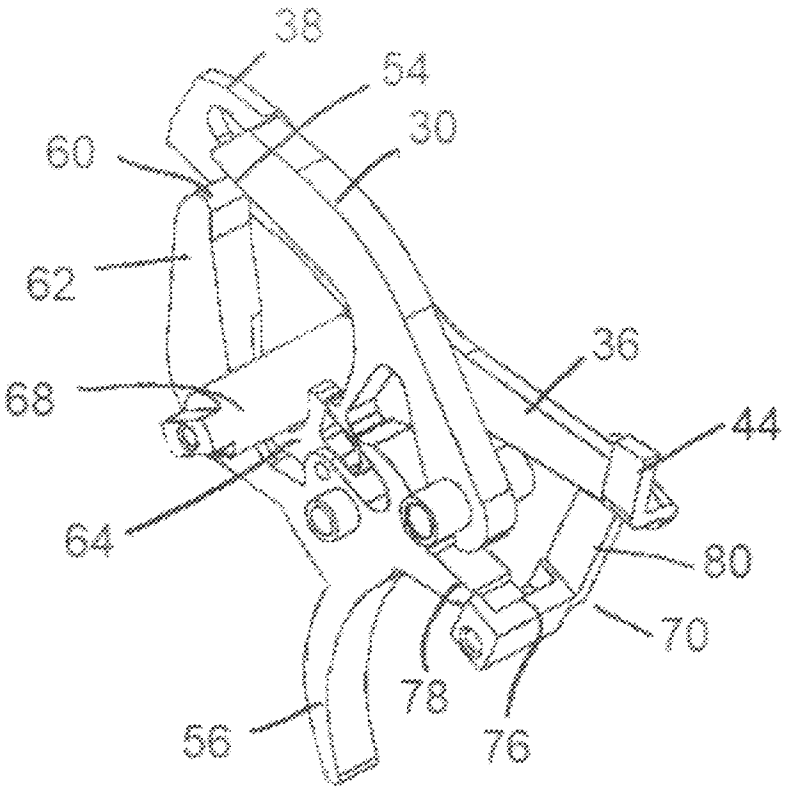
FIG. 4 is similar view with the trigger housing removed for clarity.
Figure 5:
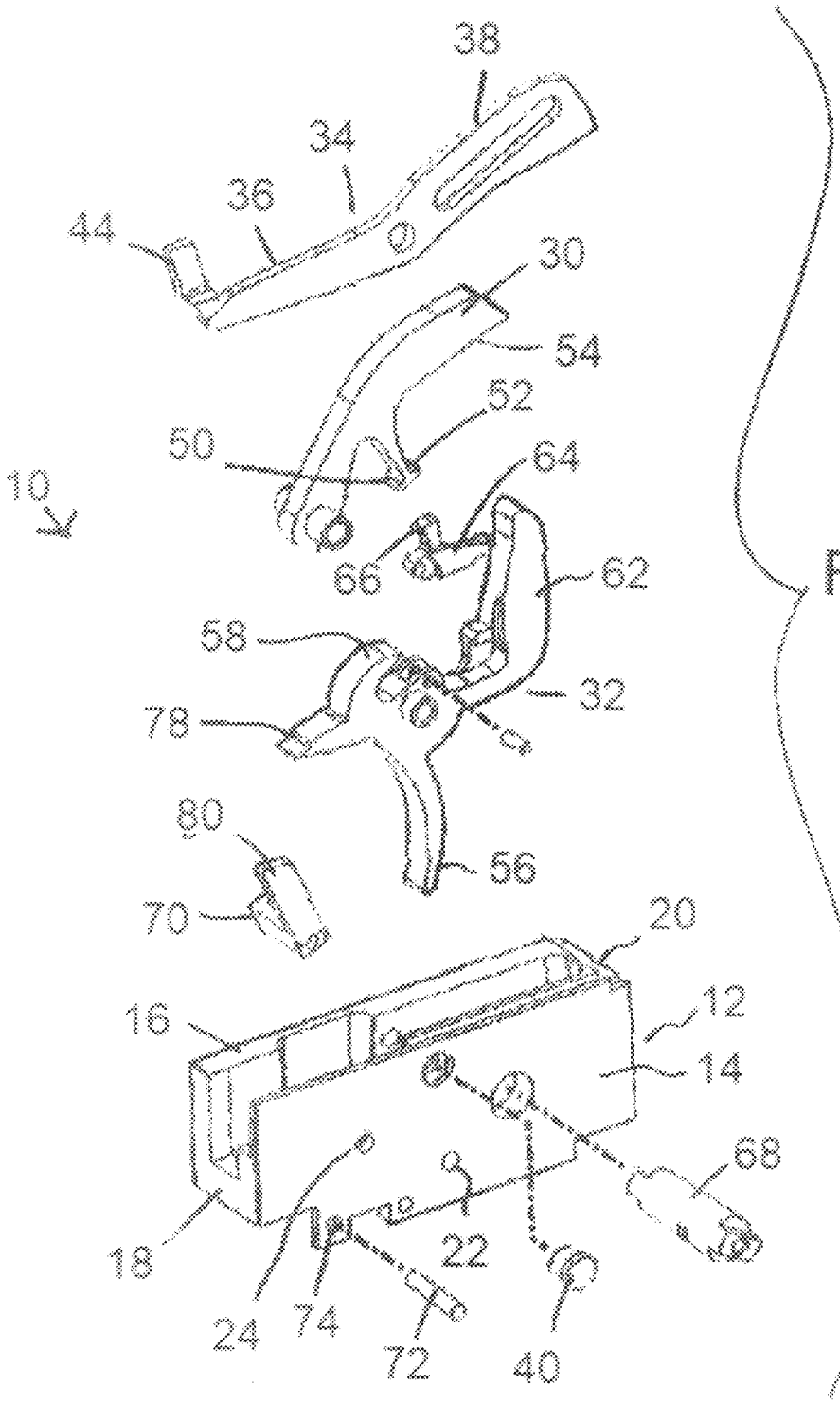
FIG. 5 is top left front exploded isometric view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the respective sides or directions according to the user's orientation, "top" or "up" will be the upward direction when the firearm is gripped in the ordinary manner. As used herein, the "substantially in-battery" position of the bolt carrier or bolt refers to being almost fully in-battery when the ejector lever first makes contact with the locking member and begins to move the locking member out of the locked position. The locking member is fully moved to the unlocked position by the point or time at which continued final movement of the bolt carrier or bolt causes it to reach the fully in-battery position.

This detailed description assumes the person of ordinary skill in the art is familiar with the construction and operation of the standard (OEM) semi-automatic fire control mechanism (trigger pack) of an MP5-pattern firearm. As used herein, "MP5-pattern" firearm includes variants thereof of any caliber, whether in a rifle or pistol configuration. While select fire (fully automatic capable) versions of this platform are also MP5-pattern firearms, this invention only relates to semiautomatic firearm actions.

Referring first to FIGS. 1-5, there is illustrated a trigger mechanism module 10 adapted for use in an MP5-pattern firearm according to a first embodiment of the present invention. The module 10 includes a trigger housing 12 sized and shaped to fit within the internal fire control pocket of a grip housing (not shown) in place of a trigger pack module/housing for a common (OEM) MP5 semiautomatic trigger group. Some fire control mechanism parts (such as some springs) not important to the disclosure or operation of present invention are well-known in the art and are omitted from the drawing figures for clarity. The housing 12 includes left and right sidewalls 14, 16 which extend substantially vertically and parallel to one another in a laterally spaced-apart relationship. The sidewalls 14, 16 are interconnected by transverse forward and rear end walls 18, 20. The sidewalls 14, 16 include at least first and second pairs of aligned openings 22, 24 for receiving transverse pins 36, 28 upon which a hammer 30 and trigger member 32 pivot.

Original to the MP5-pattern trigger mechanism is an ejector 34 that is situated laterally offset in the left side of the housing 12. The ejector 34 has the form of a crank arm with a central pivot between forward and rearward extending arms 36, 38. The ejector 34 pivots on a pin 40 carried by at least one sidewall 14 of the housing 12. The rearward arm 38 is spring biased (spring not shown) upward as in the OEM pattern trigger assembly, which moves the forward arm 36 down. Rearward movement of the bolt carrier 42 (illustrated in FIG. 8) contacts the rearward arm 38 of the ejector 34, pushing it downward against the spring and causing the forward arm 36 to be lifted. Upward movement of the forward arm 36 moves an extension finger 44 into a longitudinal slot in the bolt carrier 42 and into the path of the cartridge casing (not shown) being extracted from the chamber, causing the casing to be ejected laterally to the right. Forward return movement of the bolt carrier 42 (FIGS. 6 and 7) pushes the forward arm 36 of the ejector 34 downward.

The hammer 30 has a hammer head portion 46 that strikes a firing pin 48 when released, a sear catch 50, a hammer disconnector catch 52, and a contact surface 54. The hammer 30 is spring biased (not shown) toward a forward position by a coiled tension spring, similar in design and function to the hammer spring of an AR-pattern fire control mechanism. As shown, the sear catch 50 and disconnector catch 52 may be on opposite sides of a projection from the rear edge of the hammer 30, the operation of which will be described later.

The trigger member 32 has a trigger blade 56 that extends downwardly. The trigger blade 56 is the part of the trigger member 32 contacted by a user's finger to actuate functioning of the trigger mechanism by user input. The trigger member 32 has a sear 58 which, in the illustrated embodiment, is positioned above the pivot axis of the trigger member 32. When the trigger sear 58 and the sear catch 50 of the hammer 30 are engaged, the hammer 30 and trigger member 32 are in their set positions holding the hammer against the force of the hammer spring (illustrated in FIG. 6). When the trigger member 32 is functioned by the user pulling the trigger blade 56 toward the rear, the sear 58 releases the hammer t30 o be propelled into the firing pin 48 by the hammer spring. A trigger spring (not shown) biases the trigger member 32 toward a ready-to-fire or set position in which the blade 56 is in a forward position.

The trigger member 32 and hammer 30 have contact surfaces 54, 60 that interact with each other as the action cycles. In the illustrated embodiment, the trigger member 32 includes an upward extension 62 at the rear that provides the contact surface 60. Just as in the standard MP5-patter trigger assembly, when the bolt carrier 42 cycles to the rear, the hammer 30 is pivoted to (or beyond) the set position in which the sear catch 50 will be caught by the sear 58 of the trigger member 32. The hammer and trigger member contact surfaces 54, 60 make contact so that the resetting movement of the hammer 30forces the trigger member 32 to the reset position.

A disconnector 64 is pivotally mounted on the trigger member 32 and has a disconnector hook 66 configured to catch the disconnector catch 52 on the hammer 30. The disconnector 64 is spring biased by a spring (not shown) toward a position in which it will engage the disconnector catch 52 of the hammer 30 and can be moved against the spring force to a position in which it does not engage the disconnector catch 52 of the hammer 30. This allows selective use or operation of the disconnector 64, depending on the mode in which the trigger module 10 is being operated (controlled by the safety selector switch 68), as will be described in greater detail below.

A blocking or locking member 70 is movably mounted to the housing 12. For example, the locking member can be pivoted on a locking member pivot pin 72 that is installed in aligned openings 74 in the sidewalls 14, 16 of the housing 12. The locking member 70 is movable (pivotable, in the illustrated embodiment) between first and second positions. The locking member 70 is spring-biased (not shown) toward the first position (FIG. 8), in which a contact surface 76 engages a forwardly extending tongue 78 of the trigger member 32 to block the trigger member 32 from being moved from the set/ready-to-fire position (in which the trigger sear 58 engages the hammer sear catch 50). In this first position, the trigger member 32 cannot be functioned by the user applying rearward force to the trigger blade 56.

The locking member 70 has an arm 80 that is configured to engage with and be displaced by contact with downward movement of the forward arm 36 of the ejector 34. When the forward arm 36 of the ejector 34 is pushed downward by spring force upon the forward cycling of the bolt carrier 42, the forward arm 36 contacts and displaces the locking member arm 80 to move the locking member 70 against the force of the locking member spring to a second position (FIGS. 6 and 7), in which it allows the trigger member 32 to be functioned by the user applying rearward force to the trigger blade 56. The trigger member 32 is unlocked as the bolt carrier 42 reaches its substantially in-battery position, after which, the trigger member 32 can again be functioned by force of the user's finger to fire a subsequent round.

Figure 6:
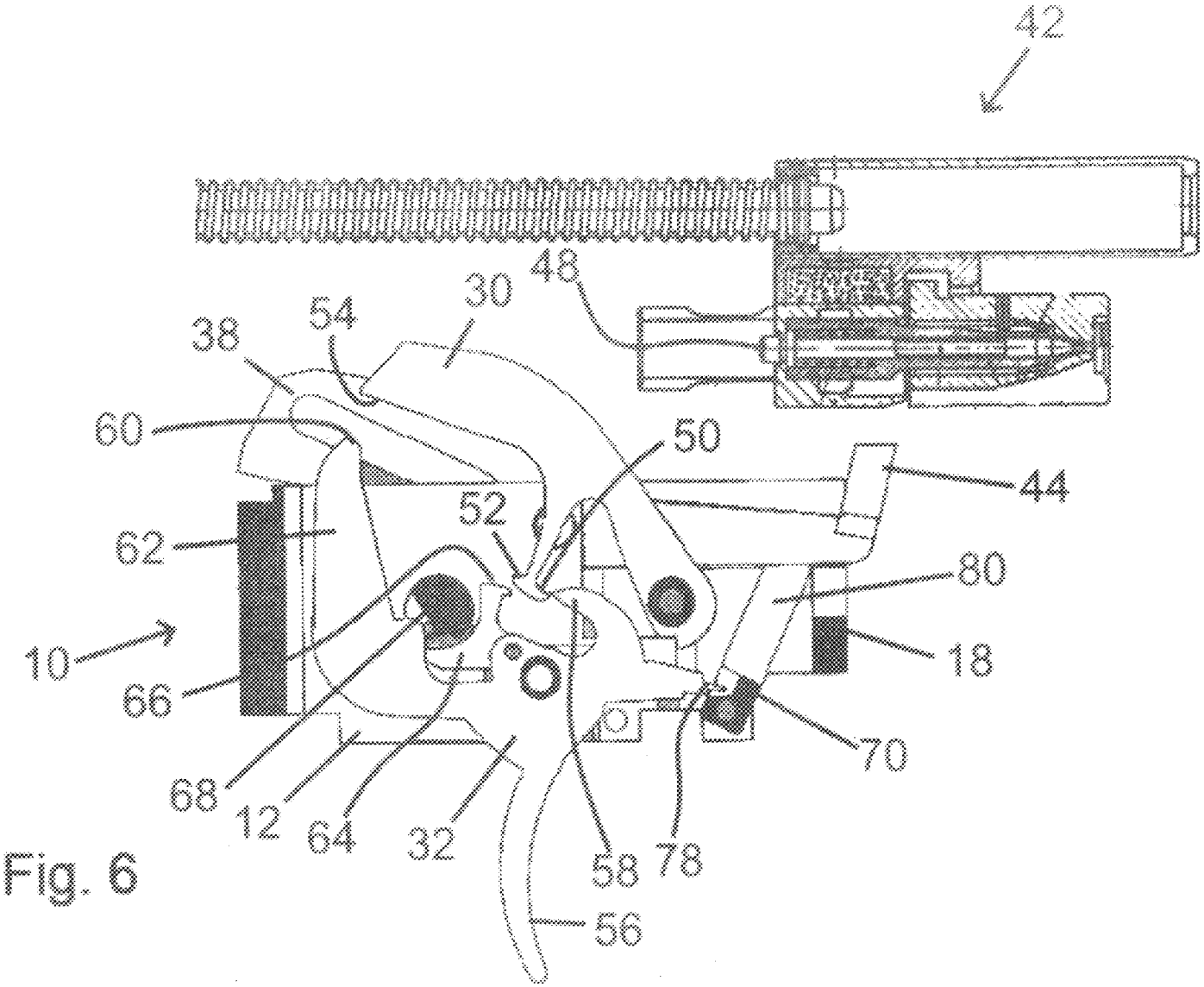
FIG. 6 is a right view thereof with a bolt carrier assembly forward with the hammer and trigger member in their set positions.

A three-position safety selector 68 has safe, standard semi-automatic, and forced reset semi-automatic positions corresponding to these modes of operation. When in the safe position, a portion of the safety selector 68 mechanically blocks movement of the trigger member 32 to prevents the trigger blade 56 from being pulled (FIG. 6).

Figure 7:
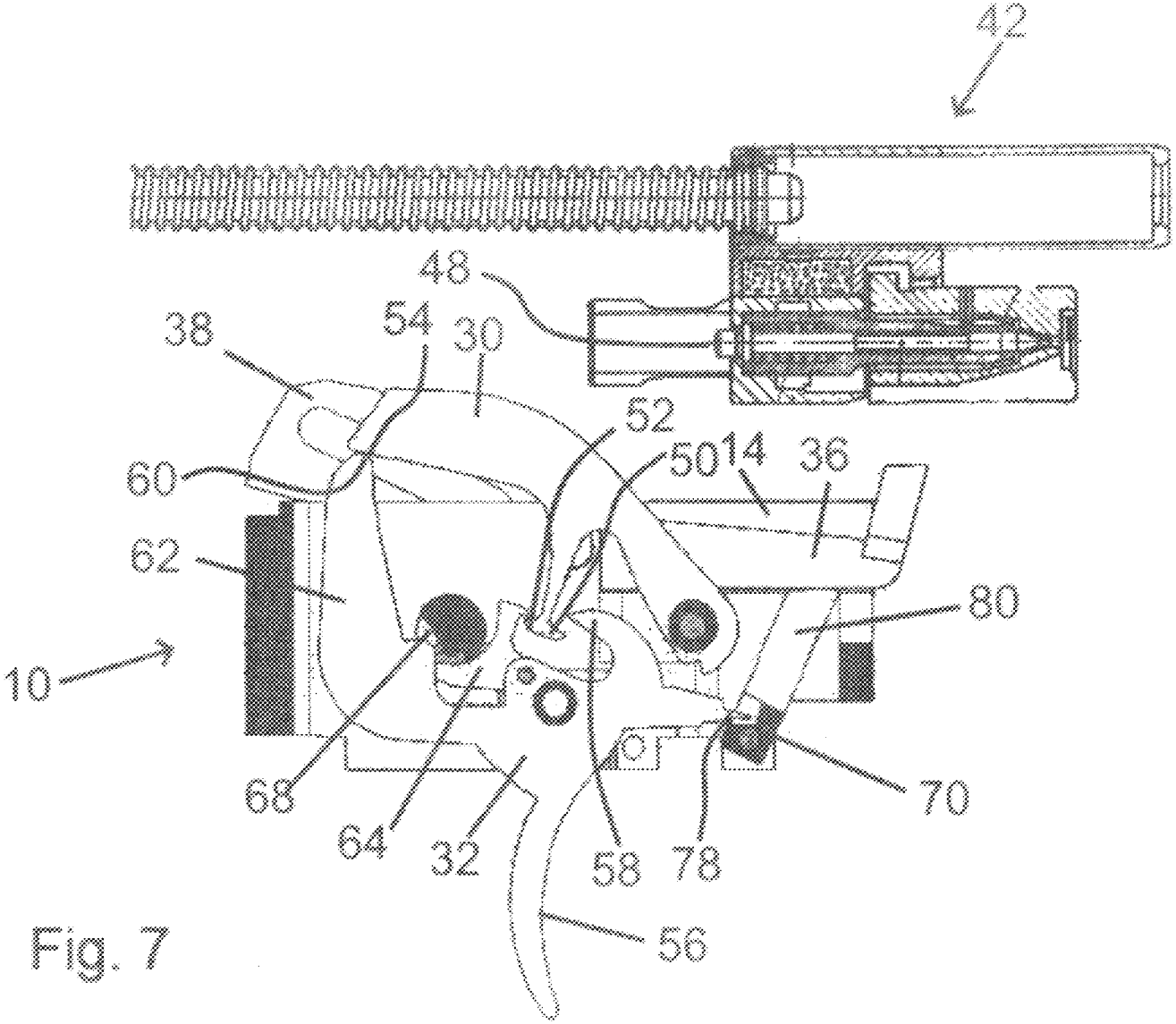
FIG. 7 is a similar view showing the hammer caught by the disconnector.
Figure 8:
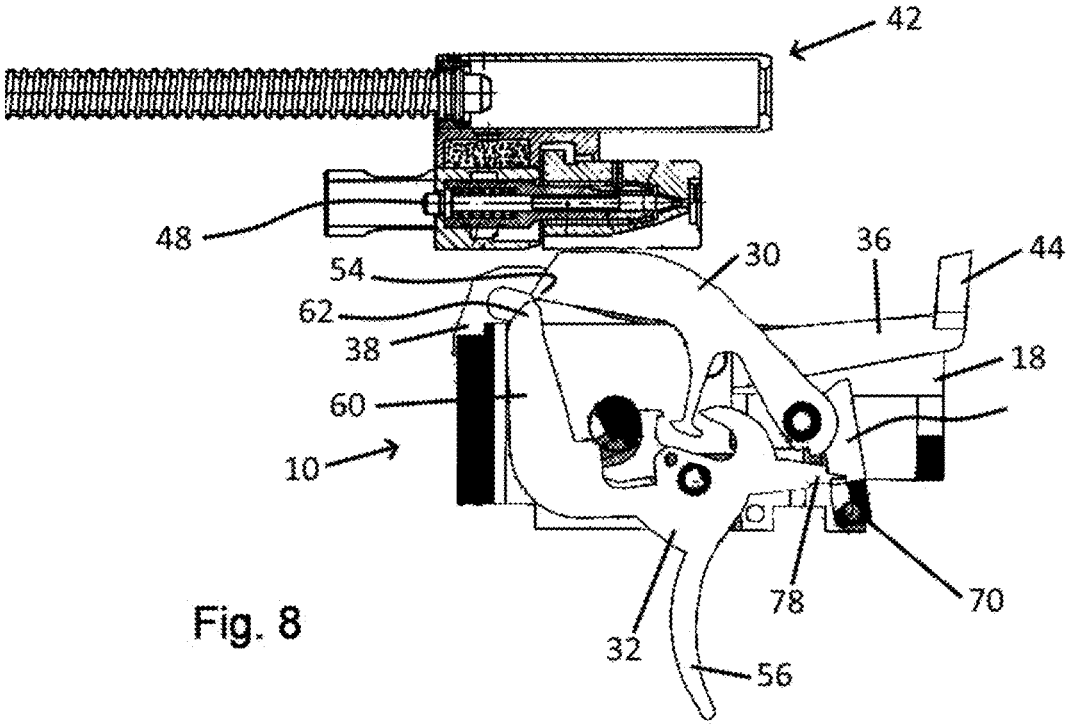
FIG. 8 is a similar view with the bolt carrier cycled to the rear, resetting the hammer.

When in the standard semi-automatic position, the blocking portion of the safety selector 68 is rotated away, permitting the trigger member 32 to be functioned by the user pulling the blade 56 rearward. The disconnector 64 is carried by the trigger member 32 and moves when the trigger member 32 is rotated. The disconnector hook 66 can catch the hammer disconnector catch 52 during rearward pivoting travel of the hammer 30 (FIG. 7). In this mode, the hammer and trigger contact surfaces 54, 60 engage/contact and the trigger member 32 is forced toward the reset position. The hammer 30 is caught by the disconnector 64 and held until the user further reduces force on the trigger blade 56 so that the trigger spring further moves the trigger member 32 to cause the disconnector 64 to release the hammer 30. Once released by the disconnector 64, the sear catch 50 on the hammer 30 is caught by the sear 58 on the trigger member 32. The trigger member 32 may then be caused to function again by the user to fire a subsequent round.

When in the forced reset semi-automatic mode (safety selector is in the third or forced rest position), the selector 68 permits the trigger member 32 to be functioned (trigger blade 56 to be pulled) but holds the disconnector 64 displaced against the disconnector spring, preventing the disconnector hook 66 from catching the hammer disconnector catch 52 during rearward pivoting travel of the hammer 30. Thus, in the forced reset semi-automatic position, the disconnector 64 is "disabled" in that the disconnector hook 66 is unable to catch the hammer disconnector catch 52 during cycling of the action and resetting of the trigger member 32. Instead, when the hammer 30 is displaced by rearward travel of the bolt carrier 42 and contact by the hammer 30 against the contact surface 60 of the trigger member 32 causes the trigger member 32 to be forced to the reset position, the hammer sear catch 50 is caught by the trigger sear 58. The locking member 70 prevents the trigger member 32 from being functioned again until the bolt carrier 42 is substantially in battery. The locking member 70 is displaced to its second position against its spring by contact of the arm 80 with the forward ejector arm 36 returning to its downward position. Once the locking member70 is displaced to the second position, the trigger member 32 is unlocked so that it can again be functioned by external force (the user pulling the trigger blade backward) to fire a subsequent round.

Thus, as the bolt carrier assembly 42 returns forward, the trigger member 32 is held in its set position by the locking member 70. The trigger member 32 cannot be pulled to release the sear/sear catch 50, 58 engagement, thus precluding early hammer release or "hammer follow" against the bolt carrier assembly 42 and firing pin 48 as the bolt carrier assembly 42 is returning to battery. When the bolt carrier assembly 42 has reached (or nearly reached) its closed, in-battery position, the forward arm 36 of the ejector 34 contacts and displaces the upward arm 80 of the locking member 70, disengaging the contact surface 76 of the locking member 70 from the tongue 78 of the trigger member 32, allowing the trigger member to be function by the blade 56 being pulled by the user. Again, this prevents early hammer release and contact of the hammer 30 against the firing pin 48 before the bolt carrier 42 is completely locked and in-battery.

While various embodiments of the present invention have been described in detail, it should be apparent that modifications and variations thereto are possible, all of which fall within the true spirit and scope of the invention. Therefore, the foregoing is intended only to be illustrative of the principles of the invention. The invention resides in each individual feature described herein, alone, and in any and all combinations and subcombinations of any and all of those features. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm trigger mechanism, comprising a hammer having a sear catch and a disconnector-engaging catch, the hammer pivoting on a transverse hammer pivot axis between set and released positions, and the hammer adapted to be pivoted rearward by rearward movement of a bolt carrier;

a trigger member having a sear and pivoting on a transverse trigger member pivot axis between set and released positions, the trigger member having a surface positioned to be contacted by the hammer during rearward pivoting of the hammer to cause the trigger member to be forced to the set position, such that the trigger member sear and hammer sear catch are in engagement in the set positions of the hammer and trigger member and are out of engagement in the released positions of the hammer and trigger member;

a disconnector having a hook for engaging the disconnector-engaging catch of the hammer and adapted to be movably mounted on the trigger member;

an ejector having the form of a crank arm with rearward and forward arms and a pivot axis, rearward movement of the bolt carrier contacting the rearward arm, causing the forward arm to be lifted into the path of a cartridge casing being extracted from a barrel chamber;

a locking member adapted to move between a first position at which the locking member mechanically blocks the trigger member from moving to the released position and a second position at which the locking member does not mechanically block the trigger member allowing the trigger member to be moved to the released position, the locking member being spring biased toward the first position and adapted to be moved against the spring bias to the second position by contact from the ejector lever during forward movement of the bolt carrier as the bolt carrier reaches a substantially in-battery position;

a safety selector adapted to move between three positions defining safe, standard semi-automatic, and forced reset semi-automatic modes;

wherein, in the standard semi-automatic mode, rearward movement of the bolt carrier causes rearward pivoting of the hammer such that the disconnector hook catches the hammer hook, at which time a user must manually reduce pressure on the trigger member so that the trigger spring moves the trigger member to free the hammer from the disconnector, permitting the trigger member to pivot to the set position so that the sear engages the hammer sear notch, and thereafter, the user can pull the trigger member functioning it to fire the firearm again;

wherein in the forced reset semi-automatic mode, rearward movement of the bolt carrier causes rearward pivoting of the hammer causing the trigger member to be forced to the set position and prevents the disconnector hook from catching the disconnector-engaging catch of the hammer, instead the trigger being forced to the reset position where its sear catches the sear catch of the hammer; and wherein as the bolt carrier reciprocates to the rear and the forward arm of the ejector is lifted, the locking member is spring biased toward the first position, and as the bolt carrier returns forward, the forward arm of the ejector is depressed, which in turn moves the locking member to the second position in which it does not block the trigger member from being functioned by an external force away from the set position and when the bolt carrier reaches the substantially in-battery position, the user can pull the trigger member again to fire a subsequent round.

2. The firearm trigger mechanism of claim 1, further comprising a trigger housing that supports the hammer, trigger member, ejector, and locking member, the trigger housing being insertable in a pocket of a trigger grip housing of the firearm.

3. The firearm trigger mechanism of claim 1, wherein the hammer includes a rearward projection carrying the sear catch and disconnector-engaging catch.

4. The firearm trigger mechanism of claim 1, wherein the safety selector blocks movement of the trigger member from the set position in the safe position, allows movement of the trigger member from the set position in the standard semi-automatic position, and both allows movement of the trigger member from the set position and prevents the disconnector hook from catching the disconnector-engaging catch of the hammer in the forced reset semi-automatic position.

5. The firearm trigger mechanism of claim 1, wherein the locking member is moved against the spring bias to the second position by contact from the forward arm of the ejector lever.

* * * * *